United States Patent [19]

Kupersmit

[11] Patent Number: 5,000,318

[45] Date of Patent: Mar. 19, 1991

[54] CONTAINER CONSTRUCTION FOR AUTOMOBILE BODIES

[76] Inventor: Julius B. Kupersmit, 299 W. 12th St., New York, N.Y. 10014

[21] Appl. No.: 489,977

[22] Filed: Mar. 7, 1990

[51] Int. Cl.[5] ..... B65D 85/68

[52] U.S. Cl. ..... 206/335; 248/500; 206/522

[58] Field of Search ..... 403/5; 248/500, 503, 248/680; 410/7, 43, 73, 76, 77, 80, 81, 90, 119; 294/119.3; 206/335, 522; 150/166

[56] References Cited

U.S. PATENT DOCUMENTS 3,738,481 6/1973 Cwycyshyn et al. ..... 206/335
3,739,906 6/1973 Cwycyshyn et al. ..... 206/335
4,428,737 1/1984 Schwenzfeier et al. ..... 403/5 X

FOREIGN PATENT DOCUMENTS 63966 3/1982 European Pat. Off. ..... 294/119.3
1917823 5/1970 Fed. Rep. of Germany ..... 410/77

*Primary Examiner*—David A. Bucci
*Assistant Examiner*—Craig Slavin
*Attorney, Agent, or Firm*—Charles E. Temko

[57] ABSTRACT

An arrangement for anchoring automobile bodies within a shipping container including a plurality of inflatable elements which are adapted to project into corresponding openings in a horizontally positioned member in an automobile body following which the elements are inflated to engage the edges of the openings and lock the body to a lower wall of the container.

3 Claims, 1 Drawing Sheet

CONTAINER CONSTRUCTION FOR AUTOMOBILE BODIES

BACKGROUND OF THE INVENTION

This invention relates generally to the field of freight handling, and more particularly to an improved container construction suitable for use in shipping fully assembled automobile bodies to an assembly plant for installation of the power train and completion of the automobile.

In the manufacture of automobiles having custom made bodies of foreign manufacture, where total production is at relatively low levels, it is desirable to be able to ship air or sea the assembled body shell from the foreign producer to an assembly plant in this country where the domestically manufactured components are installed to complete the manufacture of the automobile. While the cost of airfreight is relatively high, it is fully justified in terms of reduced part and component inventory, and the ability to have the assembled body on hand according to pre-determined schedule for rapid assembly. By suitable design, it has been possible to manufacture lightweight reusable containers for this purpose which may be employed to ship a completed automobile body in one shipping direction, and component body parts may be shipped in a return direction in the same container. In the first direction, the completed automobile body must be adequately secured to the container bottom wall so that accidental contact of the body panels with the inner surfaces of the wall of the container is prevented. Since it is not possible to anchor the body, except at the bottom surfaces thereof, without marring the body panels, there arises a need to provide an anchoring means which will interconnect an under surface of the body and an upper surface of a lower wall of the container at areas which are not readily accessible once the body is positioned within the container.

SUMMARY OF THE INVENTION

Briefly stated, the invention contemplates the provision of an improved shipping container suitable for use in shipping completely assembled automobile bodies in which provision is made for the temporary attachment of a bottom surface of the automobile body to an inner surface of a lower wall of the container. The disclosed means involves the cooperation of a plurality of expandable upwardly projecting anchoring devices which engage corresponding openings in the lower surface of the automobile body. After positioning of the body within the container, each of the inflatable means is inflated to a predetermined pressure, and to a degree in which the expanded contour thereof is larger than the corresponding opening in the body. Should the container be subjected to shifting during subsequent shipment, the expanded elements provide both a cushioning and anchoring function.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
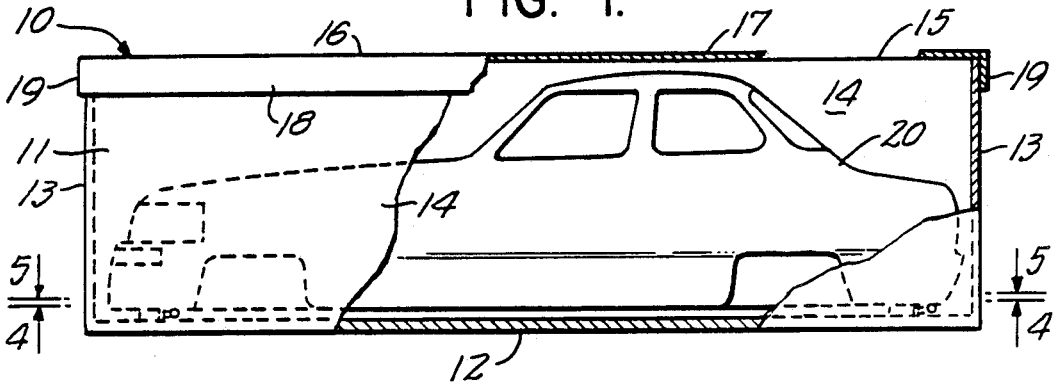
FIG. 1 is a schematic side elevational view of an embodiment of the invention with certain of the component parts removed for purpose of clarity.

With reference to the drawing, reference character 10 designates a large container adapted to contain an automotive body shell, either of integrated construction, or a type which will be subsequently assembled upon a separate chassis. The container includes a main body 11 having a reinforced lower wall 12, a pair of end walls 13, and a pair of side walls 14, the walls 13 and 14 defining a continuous upper edge 15. The container is closed by a lid element 16 having a planar wall 17, side walls 18 and end walls 19. The lid element is secured to the main body 11 in any desired fashion, such as by strapping (not shown), or by the use of expandable fasteners which penetrate the side walls 14 and 18 once the lid element 16 has been positioned.

Figure 4:
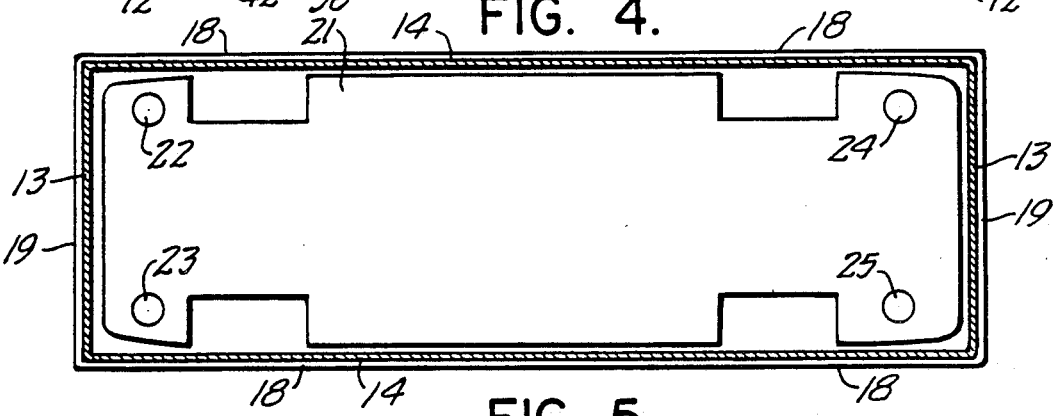
FIG. 4 is a sectional view as seen from the plane 4—4 in FIG. 1.
Figure 5:
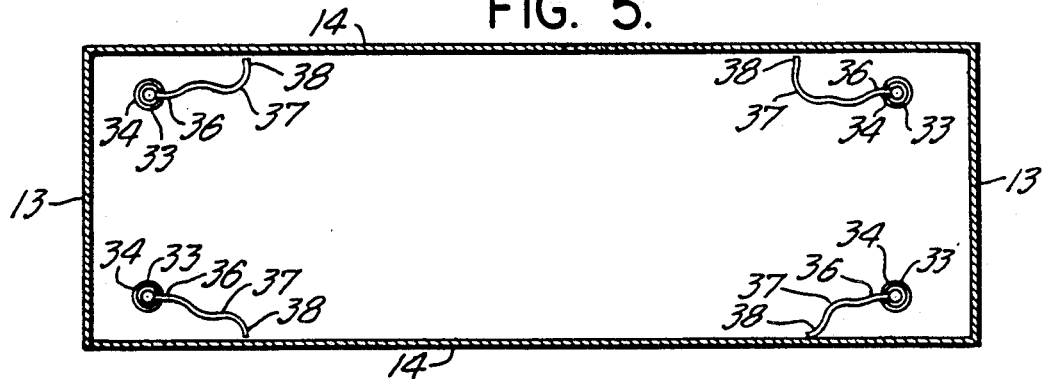
FIG. 5 is a sectional view as seen from the plane 5—5 in FIG. 1.

The automobile body 20 will normally be shipped in fully assembled and painted condition, and, thus, must be protected against shifting within the container which would permit painted panels to contact the inner surface of the container and thus mar the finish or deform the panel. The body may be of any desired configuration, and will normally include a lower horizontal panel 21 (see FIG. 4), which will form at least a portion of the floor of the body when the automobile is completely assembled. The panel 21 is provided with the usual cutouts for wheel housings (not shown) and, in addition, includes a plurality of vertically oriented through openings 22, 23, 24, and 25, preferably situated near the corners of the panel 21. These openings will ultimately serve as drain openings, or as a means for access to the interior of the body of the subsequent installation of various components.

Mounted on the upper surface 30 of the lower wall 12 are the corresponding plurality of body engagement elements 31, each including a cylindrical hollow pedestal 33 and secured at a lower end thereof by a flange 34 to the upper surface 30.

Communicating with the interior of the pedestal 33 and a first end 36 is an air hose 37, a second end 38 of which extends outwardly to the longitudinal edges of the wall 12 so as to be readily accessible after the body 20 has been positioned on the wall 12. The second end 38 is provided with a conventional valve to permit the retention of pressure of compressed air injected therethrough.

At the upper end of the pedestal 33 is an inflatable member 40 of generally spherical configuration and having an outer surface 41 bordered by a circular opening 42 which is hermetically sealed to the pedestal.

Figure 2:
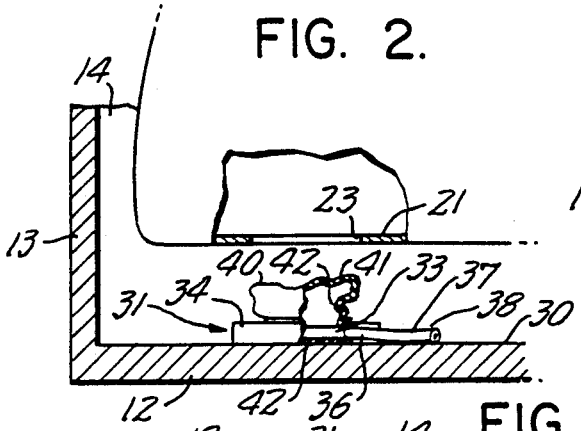
FIG. 2 is an enlarged exploded fragmentary side elevational view showing certain interlocking components in separated condition.
Figure 3:
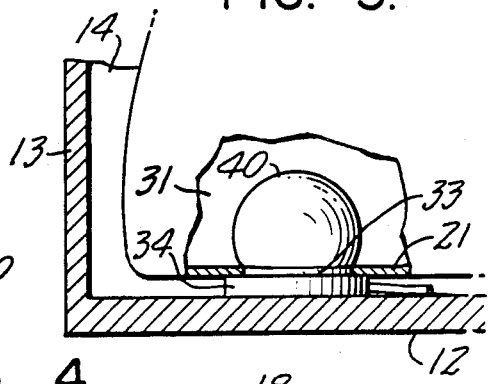
FIG. 3 is a side elevational view corresponding to that seen in FIG. 2, showing the components in engaged condition.

The function of the above described structure will be apparent from a consideration of FIGS. 2 and 3. When a container 10 is ready to receive the body 20, it is lowered into the main body 11 in such manner that the openings 22–25 are aligned with the pedestals 33 with the inflatable members 40 in relatively contracted condition. When the body has been fully lowered, the inflatable members 40 will have passed through the openings 22–25, following which compressed air, or other fluid is injected through the hoses 36 to inflate the members 40 to an effective diameter greater than that of the openings 22–25. In this condition, the body 20 will be anchored to the lower wall 12, and after positioning the lid elements 16, the container may be transported in normal fashion.

Upon arrival at its destination, the container is unloaded by removing the element 16 and deflating the members 40 to permit them to pass through the openings 22–25 as the body is lifted from the container 10.

It will be observed that because the injected air used to inflate the members 40 is still capable of additional compression, the engagement of the members 40 with the edges of the openings 22–25 will provide a degree of pneumatic cushioning which, in some instances, will serve to absorb vertical shocks imparted to the body without damage to the edges of the openings. Normally, the inflatable members 40 will be able to maintain substantially constant pressure during shipment, although, if desired, means (not shown) may be provided in the form of a self-contained source of compressed air which can periodically inject additional quantities of compressed air to counteract possible leakage.

In the alternative, a non-compressible fluid may be substituted for the compressed air with a loss of the cushioning function.

It will be observed that by resort to the disclosed invention, it is unnecessary to contact any of the finished panels of the body to accomplish anchoring of the body in the container. It is also possible to secure the body at points which are not normally accessible once the body has been positioned within the container, and the means provided is relatively simple, inexpensive to manufacture, and is devoid of mechanical linkages which would significantly add to the tare weight of the loaded container.

I wish it to be understood that I do not consider the invention limited to the precise details of structure shown and set forth in this specification, for obvious modifications will occur to those skilled in the art to which the invention pertains.

I claim:

1. In an improved container for use in shipping assembled automobile bodies in which the bodies are supported from an upper surface of a lower wall of the container, said bodies having a horizontally oriented bottom wall resting upon said surface, improved means for anchoring said bodies within said container comprising: said bottom wall of said bodies having plural openings therein and arranged in mutually spaced substantially coplanar relation; said lower wall of said container having correspondingly located anchoring means on said upper surface thereof selectively engagable with said plural openings; said anchoring means including a hollow vertically oriented tube of diameter substantially corresponding to that of said openings, means attaching a lower end of said tube to said upper surface of said lower wall, said tube having an upper end; resiliently expandable means in hermetically sealed relation and positioned upon said upper end of said tube, said last mentioned means in expanded condition having an effective diameter greater than that of said openings in said bottom wall, and less than that of said openings in contracted condition; conduit means communicating at one end thereof with the interior of said tube for the introduction of a fluid under pressure to expand said expandable means, said conduit means at a second end thereof having valving means for maintaining fluid pressure during shipment of said container, and for lowering fluid pressure prior to unloading said container.

2. Improved container construction in accordance with claim 1, in which said fluid is a compressed gas.

3. Improved container construction in accordance with claim 1 in which said fluid is a liquid.

* * * * *